US007265283B2

(12) United States Patent
Ishida et al.

(10) Patent No.: US 7,265,283 B2
(45) Date of Patent: Sep. 4, 2007

(54) STRING-STRIKING DEVICE FOR PIANO

(75) Inventors: Muneo Ishida, Hamamatsu (JP); Mitsuo Yamashita, Hamamatsu (JP)

(73) Assignee: Kabushiki Kaisha Kawai Gakki Seisakusho, Hamamatsu-shi, Shizuoka (JP)

( * ) Notice: Subject to any disclaimer, the term of this patent is extended or adjusted under 35 U.S.C. 154(b) by 75 days.

(21) Appl. No.: 10/548,684

(22) PCT Filed: Jun. 22, 2004

(86) PCT No.: PCT/JP2004/008755

§ 371 (c)(1),
(2), (4) Date: Sep. 8, 2005

(87) PCT Pub. No.: WO2004/114275

PCT Pub. Date: Dec. 29, 2004

(65) Prior Publication Data

US 2006/0169123 A1 Aug. 3, 2006

(30) Foreign Application Priority Data

| | | |
|---|---|---|
| Jun. 23, 2003 | (JP) | 2003-178660 |
| Jul. 7, 2003 | (JP) | 2003-271416 |
| Jul. 31, 2003 | (JP) | 2003-284273 |
| Apr. 15, 2004 | (JP) | 2004-120661 |

(51) Int. Cl.
*G10C 3/18* (2006.01)

(52) U.S. Cl. ..... 84/236; 84/34

(58) Field of Classification Search ..... 84/34–38, 84/105, 111, 167, 174, 236, 432, 433
See application file for complete search history.

(56) References Cited

U.S. PATENT DOCUMENTS

| | | | | |
|---|---|---|---|---|
| 4,685,371 | A * | 8/1987 | Levinson | 84/239 |
| 5,406,875 | A * | 4/1995 | Tamai et al. | 84/433 |
| 7,145,062 | B2 * | 12/2006 | Ishida | 84/35 |
| 2001/0037723 | A1 | 11/2001 | Nishida et al. | |

FOREIGN PATENT DOCUMENTS

| | | | |
|---|---|---|---|
| DE | 3728841 | A | 5/1988 |
| JP | 51-99011 | A | 6/1976 |
| JP | 56-45887 | U | 4/1981 |

(Continued)

*Primary Examiner*—Lincoln Donovan
*Assistant Examiner*—Jianchun Qin
(74) *Attorney, Agent, or Firm*—Davis Bujold & Daniels, P.L.L.C.

(57) ABSTRACT

A string-striking device for a piano, where a static loading acting on a fore-end on the playing side of a key can be easily adjusted. A long weight lever (21) is provided on each key (3). The lever (21) is installed along the length direction of the key 3, on an upper part on the side opposite the playing side of the key (3). The installation is made such that one end of the lever (21) is vertically pivotably fixed to a piano body and the vertically displaceable free-end side of the lever is in contact with the upper face of the key (3) by its own weight to apply a load on the key (3). The structure above enables a static load on the key (3) to be adjusted by replacing the lever (21) without disassembling the string-striking device and removing the key (3).

5 Claims, 11 Drawing Sheets

FOREIGN PATENT DOCUMENTS

| | | | |
|---|---|---|---|
| JP | 57-31318 | Y2 | 7/1982 |
| JP | 59-16952 | Y2 | 5/1984 |
| JP | 61-42692 | | 3/1986 |
| JP | 63-70895 | | 3/1988 |
| JP | 63-128594 | | 8/1988 |
| JP | 1-47798 | B2 | 10/1989 |
| JP | 05-108059 | | 4/1993 |
| JP | 53-23219 | | 12/1993 |
| JP | 10-240257 | A | 9/1998 |
| JP | 3206048 | B2 | 7/2001 |
| JP | 2001255875 | | 9/2001 |
| JP | 2003216143 | | 7/2003 |

* cited by examiner

STRING-STRIKING DEVICE FOR PIANO

This application is a national stage completion of PCT/JP2004/008755 filed Jun. 22, 2004, which claims priority from Japanese Application Serial No. 2004-120661 filed Apr. 15, 2004, which claims priority from Japanese Application Serial No. 2003-284273 filed Jul. 31, 2003, which claims priority from Japanese Application Serial No. 2003-271416 filed Jul. 7, 2003, which claims priority from Japanese Application Serial No. 2003-178660 filed Jun. 23, 2003, and this application is a continuation in part of U.S. Application Ser. No. 10/512,631 filed Oct. 26, 2004 which is a national stage completion of PCT/JP03/00227 filed Jan. 14, 2003 which claims priority from Japanese Application Serial No. 2002-330816 filed Nov. 14, 2002.

TECHNICAL FIELD

This invention relates to a string-striking device for a piano which enables the adjustment of the static loading (force), applied upon the key operation, to a fore-end on the playing side of a key.

BACKGROUND ART

FIG. 11 is a side view of a string-striking device 100 for a piano, comprising a key 110, a transmitting portion 120, and a hammer portion 130. Conventionally as seen in FIG. 11, in order to adjust the static loading, applied upon the key 110 depression, to a fore-end 111 on the playing side of the key 110, holes have been created on a side face 112 of the fore-end 111 on the playing side of the key 110 and leads 115, as plummets, have been buried therein. Additionally, for the impression of the sound of the key 110, the weight of the leads 115 has been adjusted so that the static loading of the key 110 is decreased gradually from the lower notes to the higher notes.

This static loading is sensed by a player of the piano as the touch and feel of the key 110. The static loading is an important parameter and how it is adjusted can determine whether the piano is considered good or bad. Thus, the static loading should be adjusted with caution in accordance with the skill and taste of the player.

In general, a string for a lower note is thicker than a string for a higher note. Therefore, a hammer 131 that strikes the string for a lower note is made larger and heavier than the hammer 131 for a higher note. Accordingly, the static loading for the lower note is heavier without the leads 115. Without the leads 115, however, especially in parts of the piano where two keys 110, residing next to each other, respectively have a different number of strings to strike, there is a problem in that the difference in the static loading between the two neighboring keys 110 becomes significantly large as compared to the case in other parts of the piano.

In the adjustment of the static loading, the weight of the leads 115 is selected to increase naturally within a reasonable range from the higher notes to the lower notes, taking into account such various factors. In this manner, the leads 115 are prepared for and attached to the respective keys 110 (see Patent Document 1, for example).

Patent Document 1: Japanese utility model publication No. 53-23219

DISCLOSURE OF THE INVENTION

Problems to be Solved by the Invention

However, once the piano is assembled, adjustment of the static loading applied to the fore-end on the playing side of the key requires replacement of the leads 115, or replacement of both the leads 115 and the key 110. For this reason, the string-striking device 100 has to be disassembled. Accordingly, after the assembly of the piano, it is not easy to adjust the static loading according to the degree of improvement of a player's skill.

The present invention was made to solve these problems. One object of the present invention is to provide a string-striking device for a piano which allows easy adjustment of the static loading applied to a fore-end on the playing side of a key.

Means for Solving the Problems

In order to solve the above problems, a string-striking device for a piano, according to the present invention, is provided with a long weight lever, one for every key. The long weight lever is disposed along the length direction of the key above the side opposite to the playing side of the key of the piano. The weight lever is arranged such that one end thereof is fixed to a piano body so as to allow the weight lever to freely swing up and down. The other open end, which can be vertically displaced, is brought into contact with the key and applies its own weight to the upper surface of the key.

As above, since the weight lever applies a weight on the key, the static loading of the key can be adjusted by changing the weight of the weight lever. Moreover, since the weight lever is provided above the key, the weight of the weight lever can be readily changed. Thus, adjustment of the static loading of the key becomes easy, as compared to a conventional case of replacing the leads buried within the key.

In addition, if the present invention is applied to an upright piano, the touch and feel similar to that of a grand piano can be obtained. This is because the motion of the weight lever is similar to that of a hammer portion of the grand piano. Immediately after a player depresses a key, the corresponding weight lever moves in accordance with the motion of the key. When the player fully depresses the key and the motion of the key is stopped, the weight lever moves independently away from the key.

However, solely providing the weight lever above the key in the aforementioned manner may cause the player to feel uncomfortable. If the player strikes the key very hard, the weight lever jumps up high and then requires time to return to the position where the lever touches the key again. Therefore, it is preferable that the string-striking device is provided with a long stopper rail secured to the piano body and extending over a plurality of weight levers. The stopper rail restricts the upward swing of the plurality of weight levers.

With the stopper rail as above, appropriate adjustment of the time required for the weight lever to return to a state in which the lever touches the key again is possible by changing the set position of the stopper rail. Furthermore, a favorable touch and feel can be provided to the player.

Adjustment of the static loading can be conducted by changing the weight of the weight lever as mentioned above. However, the string-striking device may be further provided with a moving mechanism that moves the weight lever along the length direction of a key. The static loading may be adjusted by the moving mechanism moving the weight lever with respect to the key.

The reason why the adjustment of static loading is accomplished by the moving of the weight lever with respect to the key is that moving the weight lever results in a change in the distance between the point of application of the weight, applied by the weight lever to the key, and the fulcrum of the key (i.e. the position where the key touches an intermediate plate).

In this manner, adjustment of the static loading can be done without replacement of the weight lever, thus simplifying the work of adjusting the static loading.

On the other hand, depending upon the age, taste, etc. of the player, there may be a situation in which the temporary removal of the weight of the aforementioned static loading by the weight lever is desired. To readily meet this demand, it is preferable that the string-striking device is constituted as follows. That is, the string-striking device is provided with a long lifting rail that is disposed between the weight lever and the key and extends over a plurality of keys. The lifting rail is mounted to the piano body so as to be able to displace the weight levers by lifting the same from a normal position where the levers can touch the keys and a holding position where the levers are separated from the keys.

In the device constituted as above, if the lifting rail is raised so that the weight levers are lifted to the holding position where the levers do not touch the keys, a situation is created where the weight of the weight levers is no longer applied to the keys. Conversely, when the lifting rail is lowered so that the weight levers are also lowered to the normal position where the levers touch the keys, a situation is created where the weight of the weight levers is applied to the keys. In other words, a piano can be provided in which the static loading of the keys can be easily switched between two states, without detachment or replacement of the aforementioned weight levers.

The switching operation that raises and lowers the lifting rail may be conducted when an outer panel of the piano is removed. However, it is preferable that the string-striking device is provided with a connecting member, one end of which is connected to the lifting rail and the other end is brought out to the outside of the piano. The lifting rail can be displaced by operating the other end of the connecting member outside of the piano.

If the string-striking device is constituted as such, the player does not need to take off an outer panel of the piano in order to switch the position of the lifting rail (i.e. static loading applied to the keys). Thus, this configuration is convenient. Also, the other end of the connecting member may be formed into a playing pedal. In this manner, static loading to the key can be adjusted in various ways during the play. Accordingly, the piano of the present invention can produce a sound having strength or softness which could have never been produced by a conventional piano. This pedal may be arranged in parallel to the other playing pedals (soft pedal, sostenute pedal, and damper pedal).

The weight lever may be rounded on the end part where the weight lever abuts on the key, for example. However, depending on the weight of the weight lever, there may be a situation in which excessive friction is produced between the weight lever and the key, thus affecting the touch and feel of the key. Therefore, in order to reduce the friction between the weight lever and the key, without changing the weight of the weight lever, the part of the weight lever which abuts on the key may be made in the form of a roller that can roll along the upper surface of the key.

Constituted as above, the friction between the contacting part of the weight lever and the key can be reduced. Moreover, wear of the contacting part can be prevented.

Also, in the part of the weight lever which abuts on the key, a lever receiving screw may be provided on a surface of the key facing the weight lever, so that the weight lever can be lifted by the lever receiving screw. In this case, a friction reducing layer may be provided on the undersurface of the weight lever facing the lever receiving screw. The friction reducing layer is made from a material that allows a frictional force to be smaller than a frictional force produced by direct contact between the lever receiving screw and the weight lever. Constituted as such, a frictional force generated between the weight lever and the lever receiving screw can increase static loading more than the weight of the weight lever, while the weight lever can be lifted smoothly since the lever receiving screw slides more smoothly than the case in which the lever receiving screw is slid directly on the weight lever.

However, if the friction reducing layer is made of a single material, there is a problem in that it is difficult to adjust the static loading. This is because the static loading may increase suddenly as the contact point between the lever receiving screw and the weight lever approaches a rotation axis which is a center of swing of the weight lever. Therefore, it is preferable that the friction reducing layer is made from a material that allows the frictional force to be smaller as the friction reducing layer is provided closer to the rotation axis which is the center of swing. Constituted as such, static loading is increased at a virtually constant rate. Therefore, easy adjustment of the static loading can be performed.

In another aspect of the present invention, the string-striking device for piano is provided with a long weight lever, one for every key, a weight lever stabilizing rail, and a moving mechanism. The long weight lever is disposed along the length direction of the key above the side opposite to the playing side of the key of the piano. The weight lever is arranged such that one end thereof is fixed to a piano body so as to allow the weight lever to freely swing up and down. The other open end, which can be vertically displaced, is brought into contact with the key and applies its own weight to the upper surface of the key. The weight lever stabilizing rail is secured to the piano body and extending over a plurality of weight levers. The weight lever stabilizing rail restricts the upward swing of the plurality of weight levers, and is formed in such a manner that the undersurface thereof is curved upward toward the direction opposite to the playing side of the piano. The moving mechanism moves the weight lever along the length direction of a key.

According to such a string-striking device for piano, when the moving mechanism is operated to move the weight lever along the length direction of a key, the distance from the fulcrum of the key (the intermediate plate) to the part of the key where the weight is applied by the weight lever is changed. Accordingly, the static loading applied to the fore-end on the playing side of the key can be adjusted by operating the moving mechanism.

In addition, the upward swinging range (i.e., rotation limit angle) of the weight lever is changed due to the operation of the moving mechanism. This is because the undersurface of the weight lever stabilizing rail has a shape curved upward toward the direction opposite to the playing side. Therefore, moving the weight lever toward the direction opposite to the playing side can increase the upward swinging range of the weight lever, while moving the weight lever toward the playing side can decrease the upward swinging range of the weight lever. As a result, it is possible to change the time until when the weight of the weight lever, which begins to swing upward by the depression of the key by the player, is again applied to the key. In other words, the touch and feel provided to the player after the depression of the key can be changed.

Moreover, a lever receiving screw may be set at a position on the upper surface of the key where the weight of the weight lever can be supported in any way even if the weight lever is moved by the moving mechanism. The lever receiving screw has a shape similar to the shape of a common screw.

According to such a string-striking device for a piano, even if the moving mechanism is operated and the weight lever is moved along the length direction of a key, the distance from the fulcrum of the key (the intermediate plate) to the part of the key where the weight is applied by the weight lever is no longer changed. However, the distance from the fulcrum for the swing of the weight lever to the contact point between the weight lever and the lever receiving screw is changed. Accordingly, even such a string-striking device for a piano can change the static loading applied to the fore-end on the playing side of the key by operating the moving mechanism.

As the weight lever begins to swing upward in accordance with the depression of the key by the player, kinetic energy is generated in the weight lever. When the weight lever abuts the weight lever stabilizing rail, the kinetic energy is transformed into impact, sound, heat or the like. Therefore, in a musical instrument like a piano in which sound produced when a string is struck by a hammer is enjoyed, it is desirable to inhibit generation of sound produced when the weight lever hits the weight lever stabilizing rail as much as possible. For this purpose, it is preferable that a sound-deadening material is applied to the undersurface of the weight lever stabilizing rail.

In this manner, the undesirable sound generated when the weight lever hits the weight lever stabilizing rail can be moderated as much as possible.

BEST MODE FOR CARRYING OUT THE INVENTION

The best mode for carrying out the present invention will be described below, by way of the drawings.

FIRST EMBODIMENT

Figure 1:
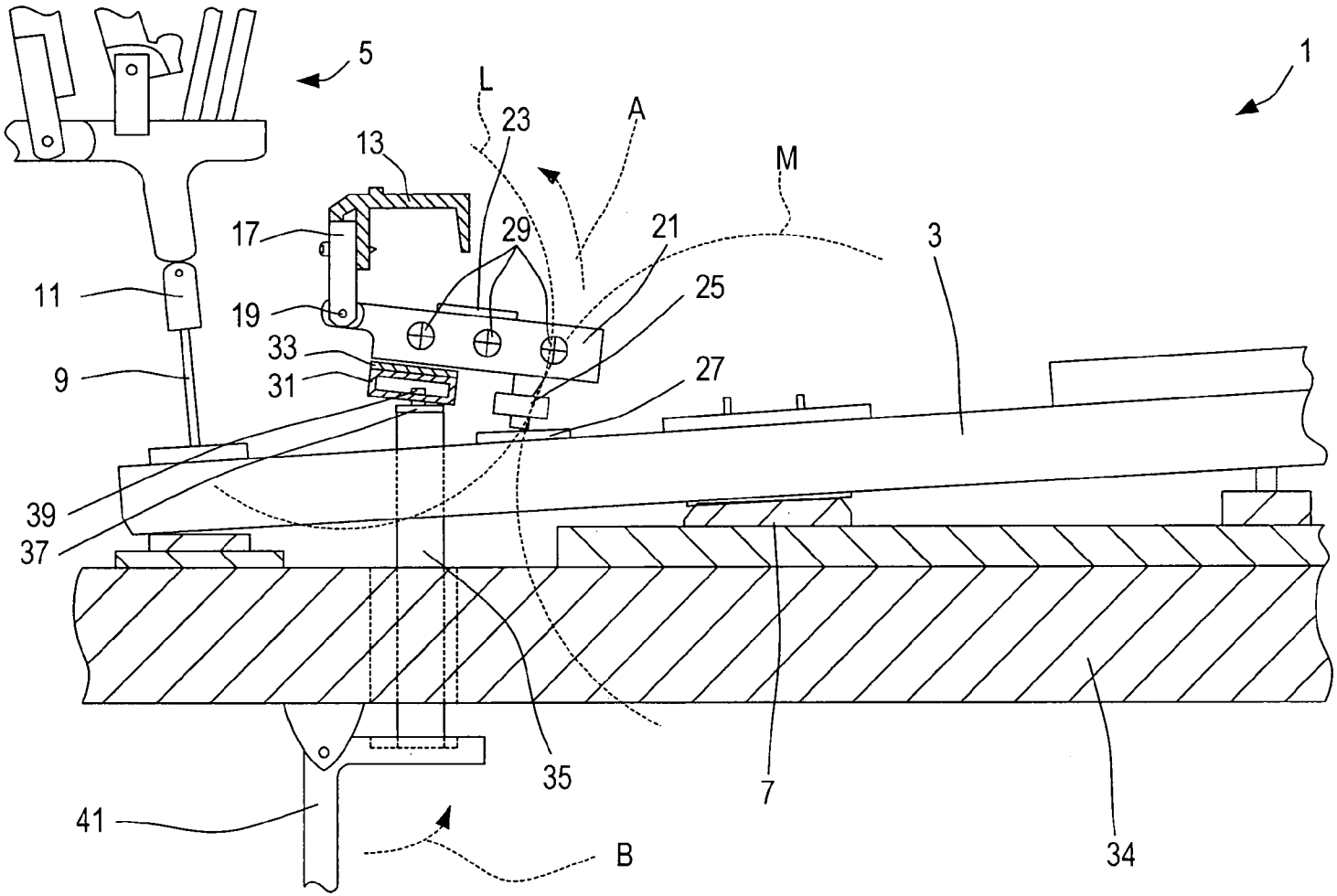
FIG. 1 is a side view showing a string-striking device for an upright piano according to a first embodiment.

FIG. 1 is a side view showing a string-striking device 1 for an upright piano. As shown in FIG. 1, the string-striking device 1 mainly comprises a key 3, a transmitting portion 5 (only a part of which is shown), and a hammer portion (not shown). The string-striking device 1 converts the motion of the key 3, resulting from the depression of the key by a player, to the motion of the hammer portion striking a string (not shown).

The piano has a total of 88 individual keys 3. Each key 3 is arranged to pivot on an intermediate plate 7 acting as a fulcrum. When a key 3 is depressed, the side opposite to the player side of the key 3 is raised to transmit the key depression to the transmitting portion 5. Particularly, the key depression is transmitted to the transmitting portion 5, and further to the hammer portion, via a capstan button 11 attached to an end of a capstan wire 9. The capstan wire 9 is provided at an end on the side opposite to the player side of the key 3. Hereinafter, the player side of the key 3 (right side in FIG. 1) is referred to as a front side, and the side opposite to the player side of the key 3 (left side in FIG. 1) is referred to as a rear side.

Above the rear side of the key 3, a long stopper rail 13 is provided which extends over a plurality of keys 3. Both ends of the stopper rail 13 are secured to the piano body by brackets 15 (not shown). Additionally, at the rear side of the stopper rail 13, a flange 17 is provided, one for every key 3, which is long in the vertical direction. The upper part of the flange 17 is fixed to the stopper rail 13 by screw. Furthermore, a weight lever 21 is rotatably attached to a rotation shaft 19 provided in the lower part of the flange 17. The weight lever 21 is arranged in parallel to the key 3 so that the rotation shaft 19 is at the rear side of the weight lever 21 and the front side of the weight lever 21 swings.

Felt 23 is provided on the upper surface of the weight lever 21 so as to reduce the undesirable sound generated when the weight lever 21 hits the stopper rail 13. On the other hand, at the front side of the undersurface of the weight lever 21, a contacting part 25 is provided which touches the key 3. Also on the upper surface of the key 3 where the contacting part 25 abuts the key 3, felt 27 is provided to reduce the sound generated upon the abutment of the contacting part 25 and the key 3. Furthermore, lead plummets 29 used for adjusting the weight of the weight lever 21 are buried in a side face of the weight lever 21.

Below the rear side of the weight lever 21, a long hollowed lifting rail 31 is provided for lifting a plurality of weight levers 21.

Figure 2:
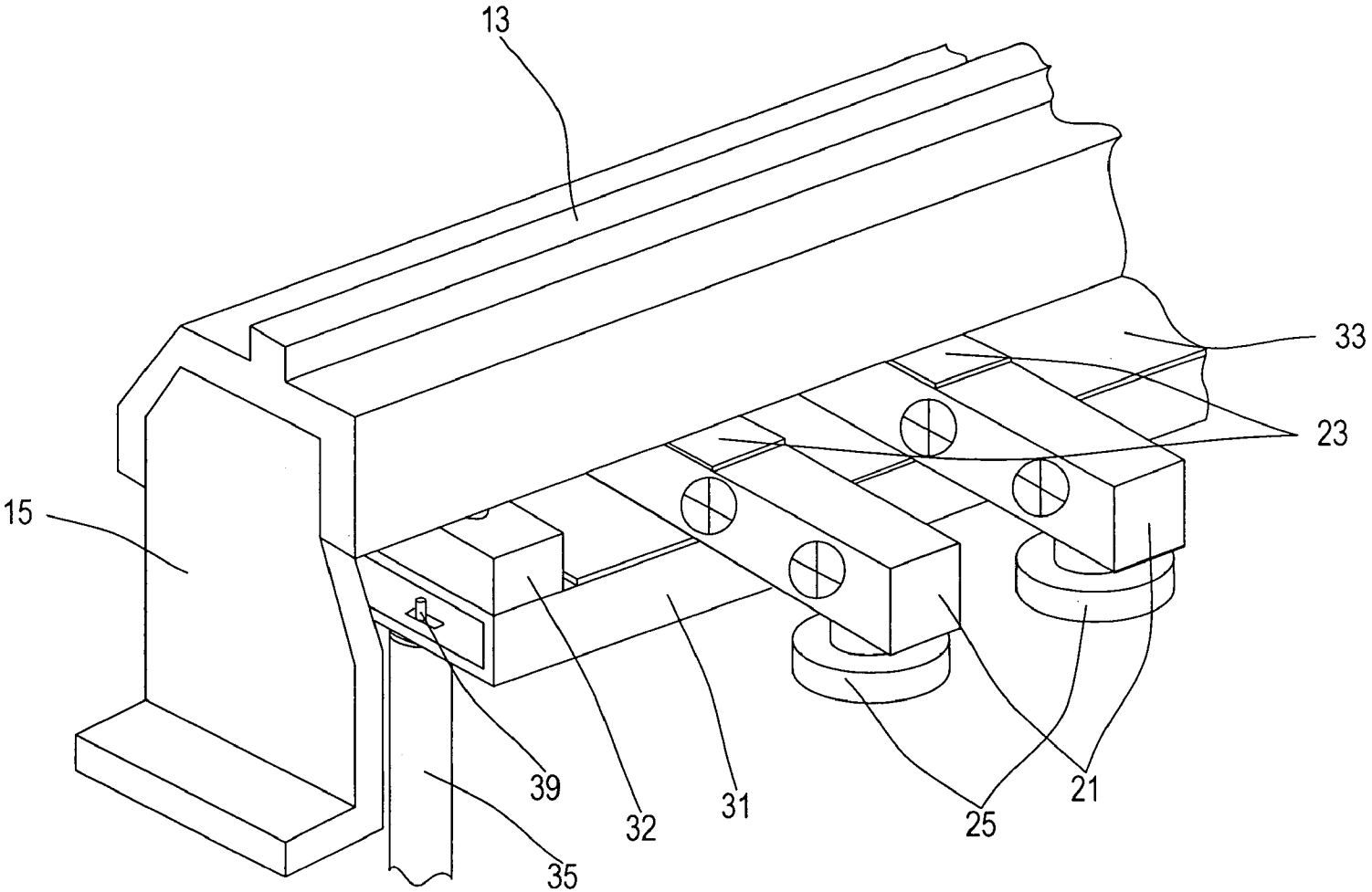
FIG. 2 is a perspective view showing the vicinity of a weight lever according to the first embodiment.

FIG. 2 is a perspective view showing the vicinity of the lifting rail 31. As shown in FIG. 2, the lifting rail 31 is secured at both ends and at several intermediate portions by lifting levers 32 provided along the arrangement direction of the keys 3. Each lifting lever 32 is fixed rotatably to the stopper rail 13 via the flange 17 in substantially the same manner as the weight lever 21. Felt 33 is provided on the upper surface of the lifting rail 31 to absorb the shock caused when the lifting rail 31 hits the weight levers 21. Below one end of the lifting rail 31, a pushup stick 35 is provided which extends upward, penetrating the key bed 34.

The upper end of the pushup stick 35 is covered with a rubber cap 37 for easing the shock caused when the pushup stick 35 hits the lifting rail 31. In the center of the upper end of the pushup stick 35, a metal pin 39 is provided in the projected manner. On the side of the lifting rail 31, a guide hole (not shown) for the pin 39 is provided.

Returning to FIG. 1, at the lower end of the pushup stick 35, an L-shaped fitting 41 is provided which is capable of supporting the pushup stick 35 on one of the sides of the L. The L-shaped fitting 41 is designed to be rotated about its corner. The other side of the L-shaped fitting 41 is connected to a wire (not shown). At one end of the wire, a handle (not shown) is provided. This handle can be pulled to the front side and pushed to the rear side. The handle can be locked at the respective states by a locking device (not shown).

The string-striking device 1 constituted as such operates as below.

When a key 3 is depressed by a player, the rear side of the key 3 is raised. The capstan wire 9 provided at the end of the key 3, together with the capstan button 11 provided at the end of the capstan wire 9, is also raised to transmit the motion of the key 3 to the transmitting portion 5. Simultaneously, the key 3 raises the weight lever 21 via the contacting part 25. As a result, the weight lever 21 rotates in the direction of arrow A about the rotation shaft 19, until the weight lever 21 hits the stopper rail 13. Once the weight lever 21 hits the stopper rail 13, the weight lever 21 stops rotation, and then due to gravity, rotates in a direction opposite to arrow A about the rotation shaft 19 until the contacting part 25 abuts on the key 3.

Additionally, by pulling the aforementioned not-shown handle to the front side, the L-shaped fitting 41 rotates in the direction of arrow B to raise the pushup stick 35, causing the lifting rail 31 to move up and raise the weight levers 21. The result is that even if a key 3 is depressed, the key 3 does not contact the contacting part 25 of the weight lever 21.

To the contrary, by pushing the handle to the rear side, the L-shaped fitting 41 is rotated in a direction opposite to arrow B so as to lower the pushup stick 35, thus lowering the lifting rail 31 and the weight levers 21. The result is that the weight levers 21 are brought back into contact with the keys 3 and the weight levers 21 apply a weight on the keys 3. Hereinafter, the position of the lifting rail 31 in this state is referred to as the normal position.

In the string-striking device 1 constituted as above, the weight lever 21 can be easily replaced with another weight lever 21 either alone or together with the flange 17, without disassembling the whole string-striking device 1. Therefore, the static loading applied to the key 3 can be adjusted. Moreover, at the beginning of the depression of the key, the weight lever 21 applies a weight to the key 3. However, once the key 3 is fully depressed and the motion of the key 3 is stopped, the weight lever 21 may continue to move independently away from the key 3, until the weight lever 21 hits the stopper rail 13. Accordingly, since the motion of the weight lever 21 is similar to that of the hammer portion of a grand piano, a touch and feel close to that caused by the key depression of a grand piano can be obtained.

Moreover, by pulling the aforementioned not-shown handle, the lifting rail 31 in the normal position is raised to a holding position where the weight levers 21 do not touch the keys 3. A state is then created in which the weight of the weight levers 21 is not applied to the keys 3. Conversely, if the lifting rail 31 in the holding position is lowered to the normal position where the weight levers 21 are brought into contact with the keys 3, a state is created in which the weight of the weight levers 21 is applied to the keys 3. That is, without replacement of the weight levers, a piano can be provided in which the static loading applied to the keys 3 can be switched between two states. Moreover, raising and lowering the lifting rail 31 can be conducted by the operation of a handle provided outside of the piano. Thus, removal of an outer panel of the piano is not necessary. This is convenient since the switching of the static loading applied to the keys 3 can be performed outside of the piano.

SECOND EMBODIMENT

From now on, a second embodiment will be described. Hereinafter, mainly only the aspects that are different from the first embodiment are described.

Figure 3:
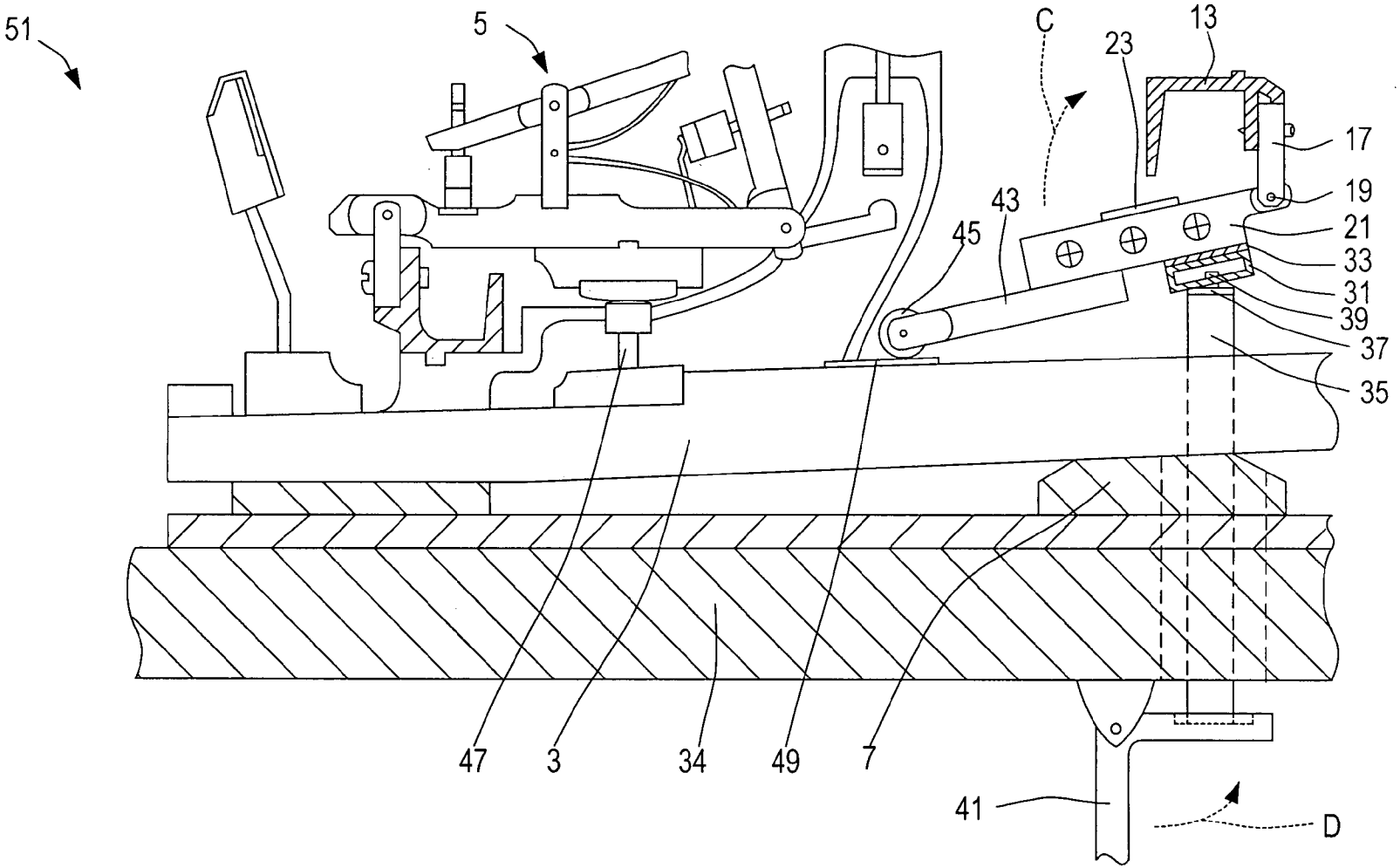
FIG. 3 is a side view showing a string-striking device for a grand piano according to a second embodiment.

FIG. 3 is a side view showing a string-striking device 51 for a grand piano. The same reference numbers are given to components identical to those in FIG. 1 and descriptions of those components are not repeated.

As shown in FIG. 3, the string-striking device 51 mainly comprises a key 3, a transmitting portion 5 (only a part is shown), and a hammer portion (not shown). The string-striking device 51 changes the motion of the key 3 resulting from the key depression by a player to the motion of the hammer portion striking a string (not shown).

A grand piano has a total of 88 individual keys 3. Each key 3 is arranged to pivot on an intermediate plate 7 acting as a fulcrum. When the front side (right side in FIG. 3) of this key 3 is depressed, the rear side (left side in FIG. 3) of the key 3 is raised so as to transmit the depression of the key to the transmitting portion 5. Particularly, the key depression is transmitted to the transmitting portion 5, and further to the hammer portion, via a capstan screw 47 provided at the rear side of the key 3.

A stopper rail 13 is secured to the piano body so as to be arranged above the intermediate plate 7. Moreover, a flange 17 is attached to the front side of the stopper rail 13. A weight lever 21 is attached rotatably to a rotation shaft 19 of the flange 17. In other words, the weight lever 21 is attached to the flange 17 such that the rear side of the weight lever 21 can swing.

Below the rear side of the weight lever 21, an extension rod 43 is provided extending further to the rear side. At the end of the extension rod 43, a roller 45 is provided to roll along the upper surface of the key 3. Felt 49 is arranged on the upper surface of the key 3 to reduce the sound produced upon the hitting of the roller 45 and the key 3.

Unlike the case of the first embodiment, a lifting rail 31 is provided below the front side of the weight levers 21. Moreover, a pushup stick 35 and an L-shaped fitting 41 are provided. A not shown wire is connected to one end of the L-shaped fitting 41, which is on the opposite side to where the pushup stick 35 is attached. Furthermore, a not shown handle is provided at the end of the wire.

The string-striking device 51 constituted as such operates as below.

When a key 3 is depressed by a player, the rear side of the key 3 is raised and the motion of the key 3 is transmitted to the transmitting portion 5 via the capstan screw 47. Simultaneously, the key 3 lifts up the weight lever 21, via the roller 45 and the extension rod 43. As a result, the weight lever 21 rotates in the direction of arrow C about the rotation shaft 19, until the weight lever 21 hits the stopper rail 13. Once the weight lever 21 hits the stopper rail 13, the weight lever 21 stops rotation, and then due to gravity, rotates in the direction opposite to arrow C about the rotation shaft 19, until the roller 45 abuts on the key 3.

Additionally, by pulling the aforementioned not-shown handle to the front side, the L-shaped fitting 41 rotates in the direction of arrow D so as to raise the pushup stick 35, causing the lifting rail 31 to rise up and raise the weight levers 21. The result is that even if a key 3 is depressed, the key 3 does not contact the roller 45.

To the contrary, by pushing the handle to the rear side, the L-shaped fitting 41 is rotated in the direction opposite to arrow D so as to lower the pushup stick 35, thus lowering the lifting rail 31 and the weight levers 21. The result is that the rollers 45 are brought into contact with the keys 3 so as to apply the weight of the weight levers 21 to the keys 3.

In the string-striking device 51 constituted as such, the same effects as in the first embodiment can be obtained. Below the rear side of the weight lever 21, an extension rod is provided extending toward the rear side. Therefore, even if the weight lever 21 is located close to the fulcrum of the key (the intermediate plate), the weight can still be effectively applied to the key 3. Moreover, a roller 45 is provided at the end of the extension rod 43, i.e. the portion where the extension rod 43 abuts the key 3. Therefore, regardless of the positional relationship between the rotation shaft 19 of the weight lever 21 and the center of rotation of the key 3 (i.e. the intermediate plate 7), the key 3 is smoothly operated. A favorable touch and feel can thereby be obtained.

THIRD EMBODIMENT

Next, a third embodiment will be described. Hereinafter, mainly only the aspects that are different than the first embodiment are described.

Figure 4:
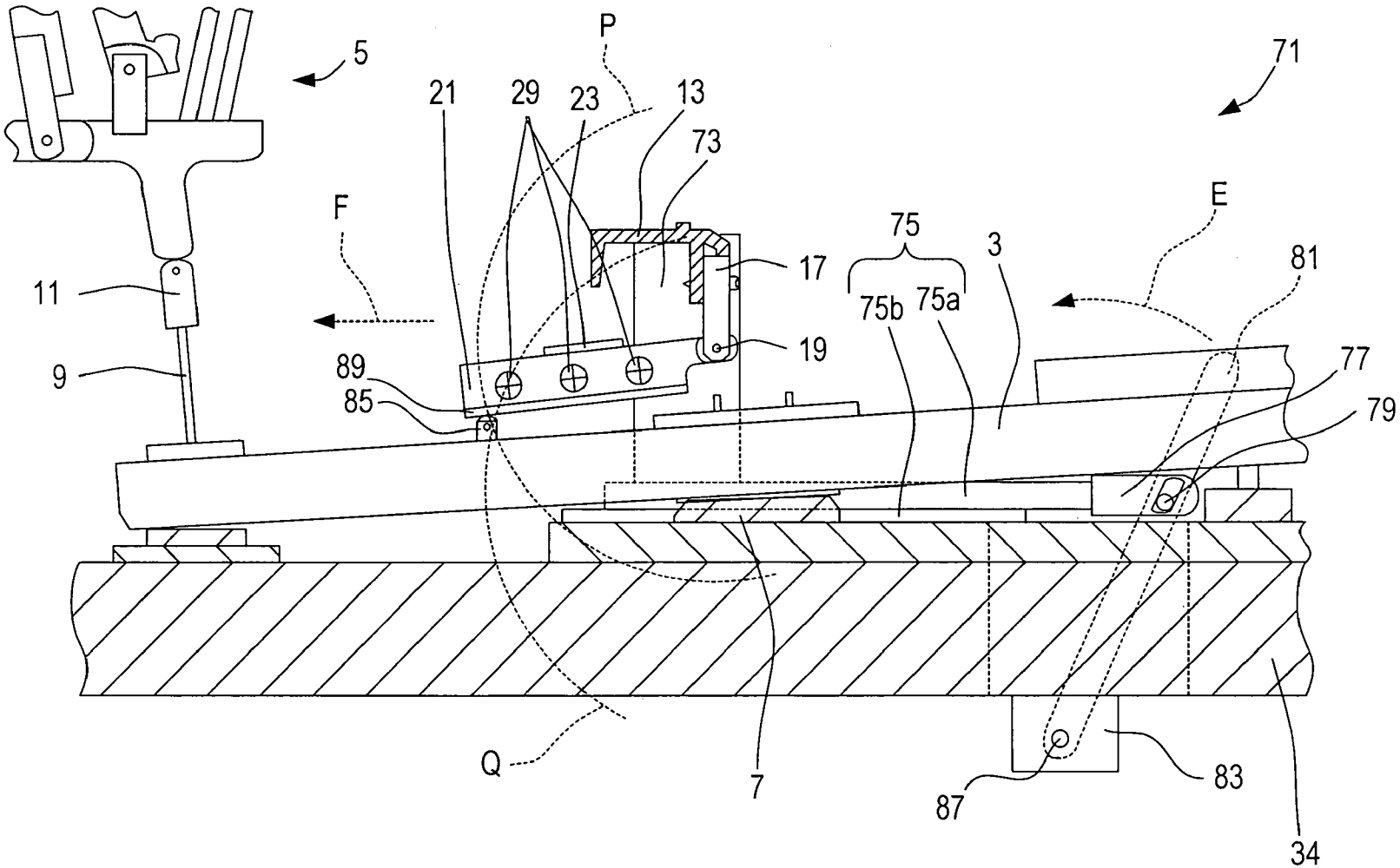
FIG. 4 is a side view showing a string-striking device for an upright piano according to a third embodiment.

FIG. 4 is a side view showing a string-striking device 71 for an upright piano. The same reference numbers are given to the components identical to those in FIG. 1. Therefore, the descriptions of the components are not repeated.

As shown in FIG. 4, the weight lever 21 of the string-striking device 71 is different in its setting direction from the weight lever 21 of the string-striking device 1 of the first embodiment (see FIG. 1). The weight lever 21 of the string-striking device 71 is arranged to extend to the rear side (left side of FIG. 4) and swing about a rotation shaft 19. Additionally, the stopper rail 13 and others are disposed in accordance with the arrangement of the weight lever 21. In the first embodiment, the contacting part 25 (see FIG. 1) is provided on the undersurface of the weight lever 21 of the string-striking device 1. However, on the undersurface of the weight lever 21 of the third embodiment, felt 89 is provided for easing any potential hitting sound. The felt 89 may be replaced with cloth or rubber.

Moreover, the weight lever 21 is designed to be supported by a lever receiving screw 85 (capstan screw) provided on the upper surface of the key 3 directly below the weight lever 21. The height of this lever receiving screw 85 can be adjusted by being screwed into or loosened out of the key 3. The contacting part of the lever receiving screw 85 with the weight lever 21 is in a rounded form. In the third embodiment, the felt 89 is provided on the weight lever 21. However, felt for inhibiting any potential hitting sound may be provided on the contacting part of the lever receiving screw 85 with the weight lever 21.

The stopper rail 13 is supported by board-like rail supporting members 73, provided at both ends and at several intermediate positions (break portions) of the stopper rail 13. Additionally, the rail supporting members 73 are respectively fixed to upper rails 75*a* of the slide rails 75. A number of slide rails 75 provided as above are shaped similar to each other. Therefore, only one example is described in the following.

A slide rail 75 is disposed in parallel to a key 3, above the key bed 34 and below the aforementioned rail supporting member 73. The slide rail 75 is comprised of an upper rail 75*a* and a lower rail 75*b*. The lower rail 75*b* is fixed to the piano body. Moreover, between the lower rail 75*b* and the upper rail 75*a*, a bearing (not shown) is provided for reducing friction therebetweeen. The upper rail 75*a* is designed to slide freely between the rear side and the front side (right side of FIG. 4) on the lower rail 75*b*. Along with the sliding of the upper rail 75*a*, the rail supporting member 73, fixed to the upper rail 75*a*, also moves between the rear side and the front side. With this movement, the stopper rail 13, and flange 17, weight lever 21, etc. attached to the stopper rail 13, are also moved. Additionally, a flange 77 is provided at the front side end of the upper rail 75*a* of an outermost slide rail 75 among a plurality of slide rails 75. An arm pin 79, provided in the flange 77, releases force, other than the force given from a later-explained arm 81 in the sliding direction of the upper rail 75*a*, and allows the arm 81 and the upper rail 75*a* to work together.

The arm 81 is attached only to the upper rail 75*a* of the outermost slide rail 75 among the plurality of slide rails 75. In other words, there are two arms 81. One end of each arm 81 is attached to an attachment portion 83 provided on the undersurface of the key bed 34 so as to be capable of being rotated about an attachment shaft 87. Thus, the two arms 81 work together via the attachment shaft 87. On the other hand, the other end of the arm 81 extends from the underneath of the key bed 34 to the key 3, penetrating through the key bed 34. Additionally, one of the two arms 81 projects further to the outside of the piano, piercing though a case member, so that a player can operate the arm 81 without opening the piano.

The string-striking device 71 constituted as such operates as below.

When a player rotates the arm 81 in the direction of arrow E, the upper rail 75*a* slides to the rear side of the piano. Along with the sliding of the upper rail 75*a*, the rail supporting member 73, stopper rail 13, flange 17, and weight lever 21, are all moved to the rear side (in the direction of arrow F). Also, when the player rotates the arm 81 in the direction opposite to arrow E, the upper rail 75*a* slides to the front side of the piano. Along with this sliding of the upper rail 75*a*, the rail supporting member 73, stopper rail 13, flange 17, and weight lever 21, are all moved to the front side (in the direction opposite to arrow F).

In this manner, as the player operates the arm 81, the position of the weight lever 21, etc. can be changed. Along with the change of position, the operating point of the weight lever 21 is moved. As a result, successive adjustment of the static loading applied to the key 3 is possible.

Furthermore, since the two arms 81 are designed to work together, by operating only one of the arms 81, all the weight levers 21 can be moved uniformly.

Figure 5:
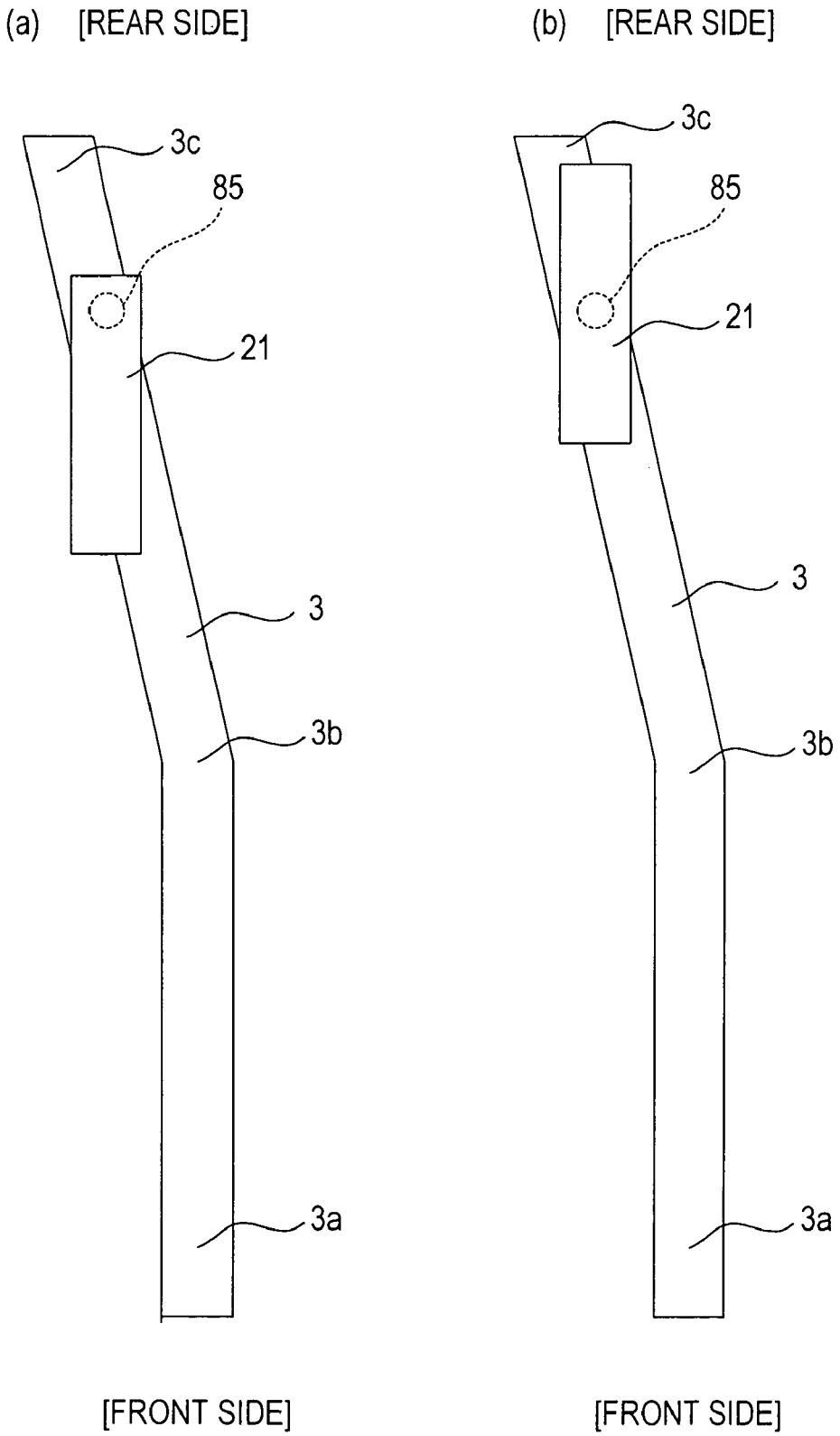
FIG. 5 is an overhead view of a key according to the third embodiment.

Next, the relationship between a weight lever 21 and a lever receiving screw 85 will be explained using drawing figures showing overhead views of the key 3. FIG. 5 is a drawing showing overhead views of one key 3, one weight lever 21, and one lever receiving screw 85, for a lower note. FIG. 5(*a*) is a drawing showing the case of the weight lever 21 arranged to the front side. FIG. 5(*b*) is a drawing showing the case of the weight lever 21 arranged to the rear side. The key 3 corresponds to a key 3 for a lower note and is thus bent at an intermediate part 3*b*. It should be noted that although not shown, a key 3 for a higher note is bent to the side opposite of the side shown in. FIG. 5.

As can be seen in FIG. 5, if the weight lever 21 is moved in parallel to a playing portion 3*a* of the key 3, the weight lever 21 can be supported by the lever receiving screw 85. If the contacting part 25 was provided at the fore-end on the swinging side of the weight lever 21, as in the string-striking device 1 of the first embodiment, the contacting part 25 would possibly move off of the upper surface of the key 3 upon the moving of the weight lever 21 in a direction parallel to the playing side of the key 3.

Therefore, the lever receiving screw 85 is provided to the key 3, as in the third embodiment, so that the weight lever 21 can be moved in parallel to the playing portion 3*a* of the key 3 and the weight lever 21 does not need to be moved parallel to the rear side portion 3*c* of the key 3. As a result, there is no need to provide a complicated mechanism which can make the weight levers 21 move in different directions depending on which side of the scale, i.e. the lower notes or the higher notes, the key 3 is located.

Moreover, the setting directions of the respective weight levers 21 in the third and first embodiments, that is, the sides of the weight lever 21 about which the weight levers 21 swing, are opposite. As a result, when the key 3 is depressed, a larger frictional force is generated between the weight lever 21 and the key 3 in the string-striking device 71 of the third embodiment as compared to the case of the string-striking device 1 of the first embodiment. The reasons for this will be explained in the following.

As shown in FIG. 1, upon depression of the key, the contacting part 25 of the weight lever 21 of the first embodiment moves along an arc L, and a part of the key 3 which abuts the contacting part 25 moves along an arc M. In this manner, the arc L and the arc M are nearly tangent to each other. Thus, in the vicinity of the tangent point of both arcs, there is not much difference in the track of motion between the contacting part 25 and the part of the key 3 which abuts the contacting part 25.

On the other hand, in the third embodiment as seen in FIG. 4, the lever receiving screw 85 moves along an arc Q and the part of the weight lever 21 which abuts the lever receiving screw 85 moves along an arc P. Accordingly, even in the vicinity of an intersection point of both arcs, there is large difference in the track of motion between the lever receiving screw 85 and the part of the weight lever 21 which abuts the lever receiving screw 85.

Therefore, a larger amount of friction is generated between the weight lever 21 and the key 3 (to be exact, the lever receiving screw 85) in the string-striking device 71 of the third embodiment as compared to the case in the string-striking device 1 of the first embodiment. Thus, by disposing the weight lever 21 as in the third embodiment, the static loading can be increased by much more than the weight of the weight lever 21.

Figure 8:
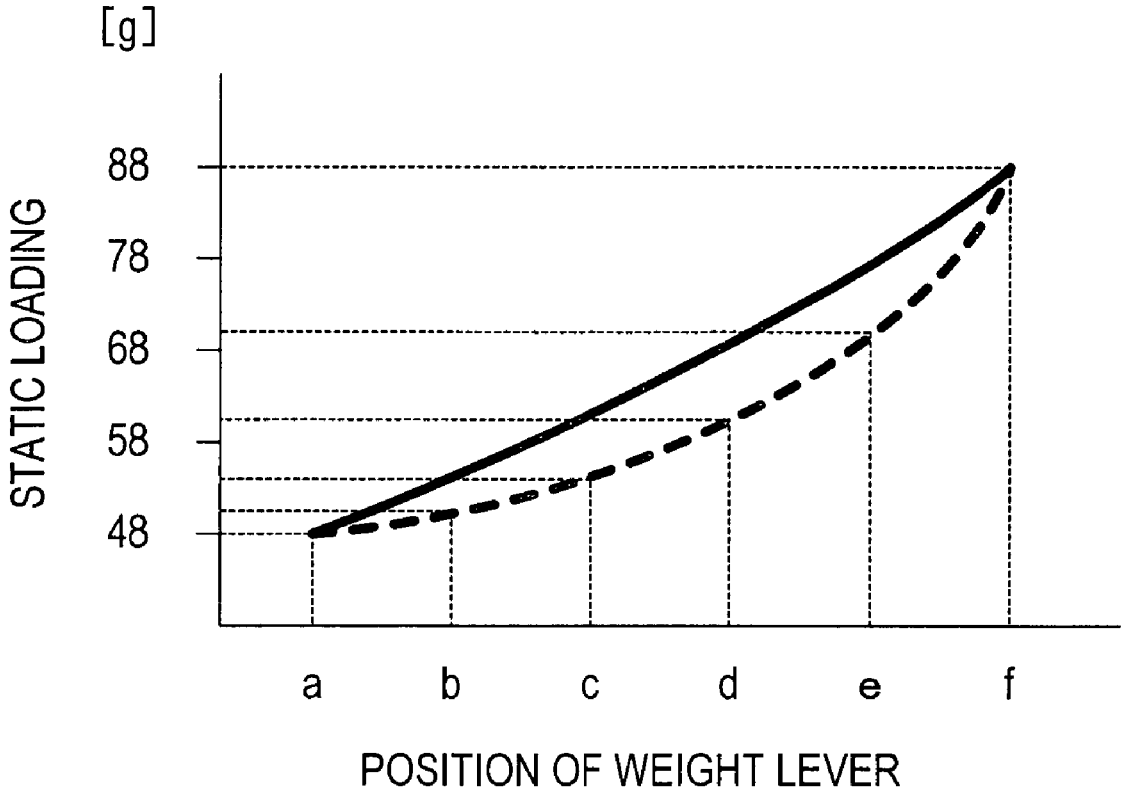
FIG. 8 is a graph showing change in static loading due to position change of the weight lever.

If a string-striking device is constituted as in the present embodiment, the static loading can be increased by much more than the weight of the weight lever 21 due to the aforementioned frictional force generated between the weight lever 21 and the lever receiving screw 85. However, referring to FIG. 8 (graph shown in a dotted line) from which it is known, as the contact point between the lever receiving screw 82 and the weight lever 21 comes closer to the rotation shaft which is the center of swing of the weight lever 21, the static loading may become suddenly heavy, thus making it difficult to adjust the static loading. Therefore, it is preferable that the closer the felt (friction reducing layer) is located to the rotation shaft which is the center of swing of the weight lever, the smaller the frictional force of the felt is. In other words, it is preferable that felt 89*a* on the front side of the weight lever 21 is made of a material having a smaller frictional force than felt 89*b* on the rear side. Constituted as such, as shown in FIG. 8, the frictional force is restrained from sudden increase (graph shown with a solid line in FIG. 8). Since the static loading is increased at a virtually constant rate, adjustment of the static loading can be easily performed.

In the present embodiment, it is preferable that the felt 89*a* on the front side is made of artificial leather, for example, while the felt 89*b* on the rear side is made of needle felt, for example, which is less expensive than artificial leather. Also, two materials with different frictional resistance are used for the felt 89 in the present embodiment. However, three or more materials having different frictional resistance may be used so that the frictional resistance can be reduced from the rear side toward the front side. Moreover, the felt 89 need not be provided on the entire undersurface of the weight lever 21. The felt 89 may only be provided at least at the portion where the lever receiving screw 85 abuts.

FORTH EMBODIMENT

Next, a forth embodiment will be described. Hereinafter, mainly only the aspects that are different than the third embodiment are described.

Figure 6:
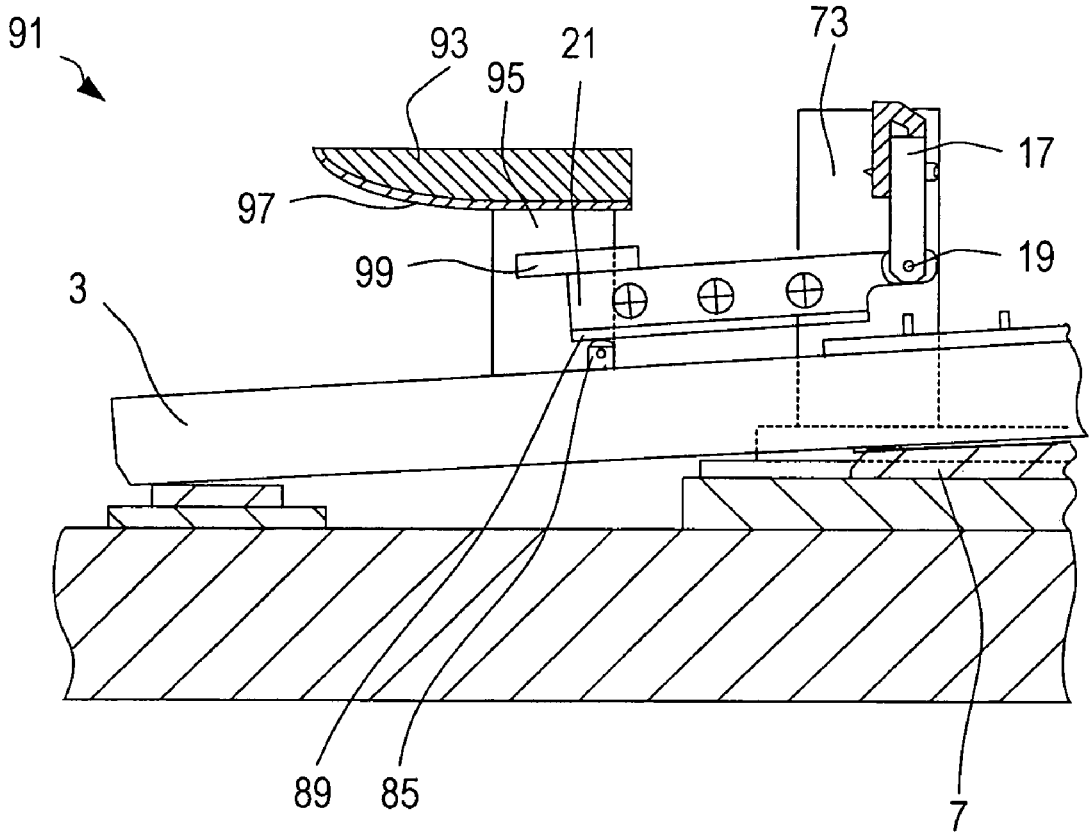
FIG. 6 is a side view showing a string-striking device for an upright piano according to a fourth embodiment.

FIG. 6 is a side view showing the vicinity of a weight lever 21 in a string-striking device 91. The same reference numbers are given to the components identical to those in FIG. 4, and the descriptions of the components are not repeated. The main difference between the string-striking device 91 of the forth embodiment and the string-striking device 71 of the third embodiment is the presence or absence of the stopper rail 13 and the presence or absence of a weight lever stabilizing rail 93. In other words, the string-striking device 91 of the forth embodiment does not possess the stopper rail 13, but possesses the weight lever stabilizing rail 93 instead.

The weight lever stabilizing rail 93 is located above the weight lever 21. The weight lever stabilizing rail 93 are is secured at both of its ends to the piano body by brackets 95 so as to extend over a plurality of keys 3. A cross section of the weight lever stabilizing rail 93 is almost rectangular. The underneath of the weight lever stabilizing rall 93 on the side (to the left side in FIG. 6) opposite to the player side (to the right side in FIG. 6) is curved. In other words, the undersurface of the weight lever stabilizing rail 93 is curved upward toward the direction opposite to the player side. Felt 97 for inhibiting any potential hitting sound is provided on the entire undersurface of the weight lever stabilizing rail 93.

A lead plummet 99 is provided on the side opposite to the player side of each weight lever 21 (left side in FIG. 6). The plummet 99 is brought into contact with the weight lever stabilizing rail 93 when the corresponding weight lever 21 swings about the rotation shaft 19.

Figure 7:
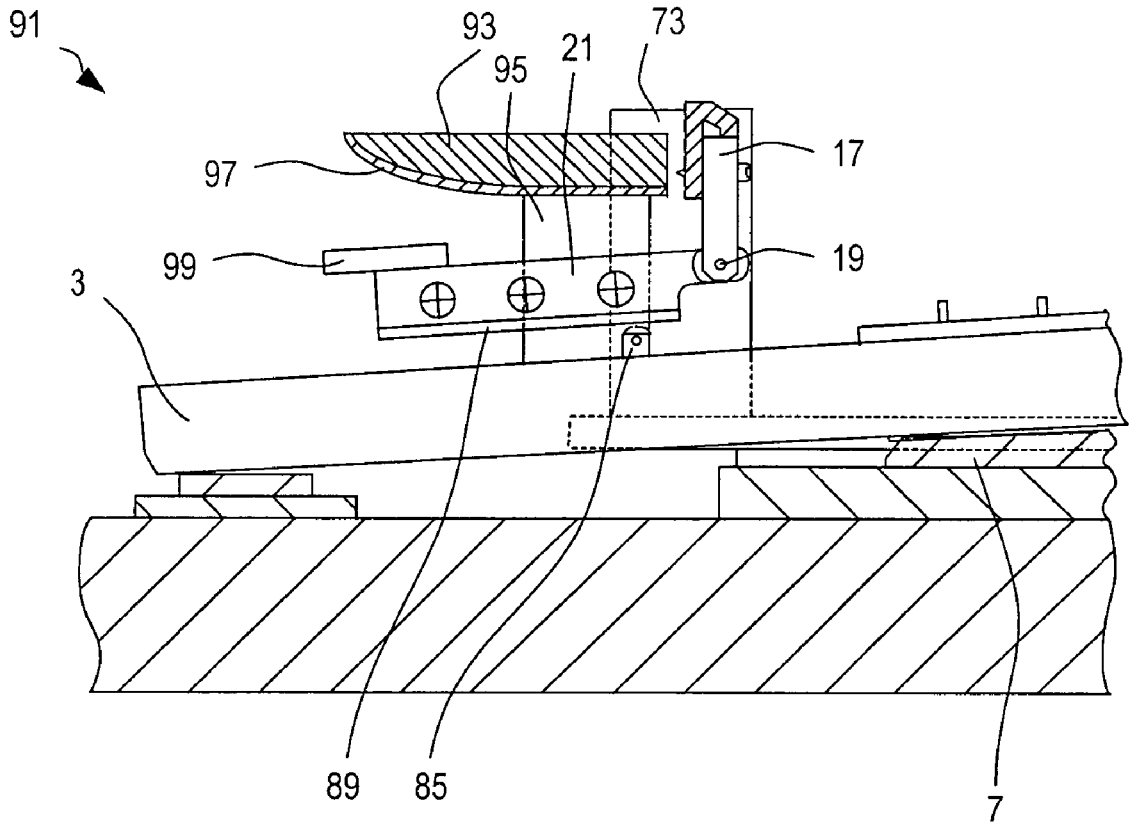
FIG. 7 is a side view showing a string-striking device for an upright piano according to the fourth embodiment.

Operation of the above string-striking device 91 is explained below. The weight lever 21 is in contact with the lever receiving screw 85 before the key 3 is depressed by a player. When the key 3 is depressed by the player, the weight lever 21 is rotated on the rotation shaft 19 until the weight lever 21 hits the weight lever stabilizing rail 93. As described in the third embodiment, the position of the weight lever 21 can be changed by operating a not shown arm 81. FIG. 7 shows a condition in which the weight lever 21 is moved to a position far from the player. FIG. 7, just like FIG.

6, is a side view showing the vicinity of the weight lever 21 of the string-striking device 91. The same reference numbers are given to components identical to those in FIG. 6 and descriptions of those components are not repeated.

When the weight lever 21 is in the position shown in FIG. 6 (i.e., position close to the player), the weight lever 21 when the key 3 is depressed is brought into contact with the undersurface closer to the player side of the weight lever stabilizing rail 93. On the other hand, when the weight lever 21 is changed to the position shown in FIG. 7 (i.e., position far from the player), the weight lever 21 when they key 3 is depressed is brought into contact with the undersurface far from the player side of the weight lever stabilizing rail 93. As can be seen from FIGS. 6 and 7, the weight lever 21 in the position of FIG. 7 has a larger rotation angle than the weight lever 21 in the position of FIG. 6. Additionally, the distance between the contact point where the weight lever 21 in the position of FIG. 7 contacts the lever receiving screw 85 and the rotation shaft 19 is increased as compared to the case of the weight lever 21 in the position of FIG. 6. Therefore, the static loading on the key 3 is increased. According to the string-striking device 91 of the forth embodiment, the position of the weight lever 21 is changed by the operation of the not shown arm 81. In accordance with the change, the static loading of the key 3 is changed in a curved manner. How the static loading is changed will be described by way of a graph in FIG. 8.

FIG. 8 is an example of a graph created by plotting the static loading of the key 3 when the position of the weight lever 21 is changed from a position a (position closest to the player) to a position f (position farthest from the player). The respective intervals between the position a, position b, potion c, position d, position e, and position f are even. As can be seen in FIG. 8, the increase of the static loading is gentle when the position of the weight lever 21 is changed from the position a to the position c. As the position of the weight lever 21 is changed from the position d to the position f, the sharp increase of the static loading appears.

As above, change in the static loading by the positional change of the weight lever 21 between the position a and the position c is smaller than that of between the position d and the position f. Accordingly, with respect to the positions from the position a to the position c, adjustment of the static loading can be closely performed by the position of the weight lever 21. On the other hand, in the positions from the position d to the position f, the static loading can be largely changed by the positional change of the weight lever 21. Therefore, if the weight of the weight lever 21 and the plummet 99 are properly set, the adjustment range of the static loading suitable for normal play can be closely adjusted according to the player's taste. Moreover, the adjustment range of the static loading for finger exercise can be performed to a large extent.

FIFTH EMBODIMENT

Next, a fifth embodiment will be described. Hereinafter, mainly only the aspects that are different than the third and forth embodiments are described.

Figure 9:
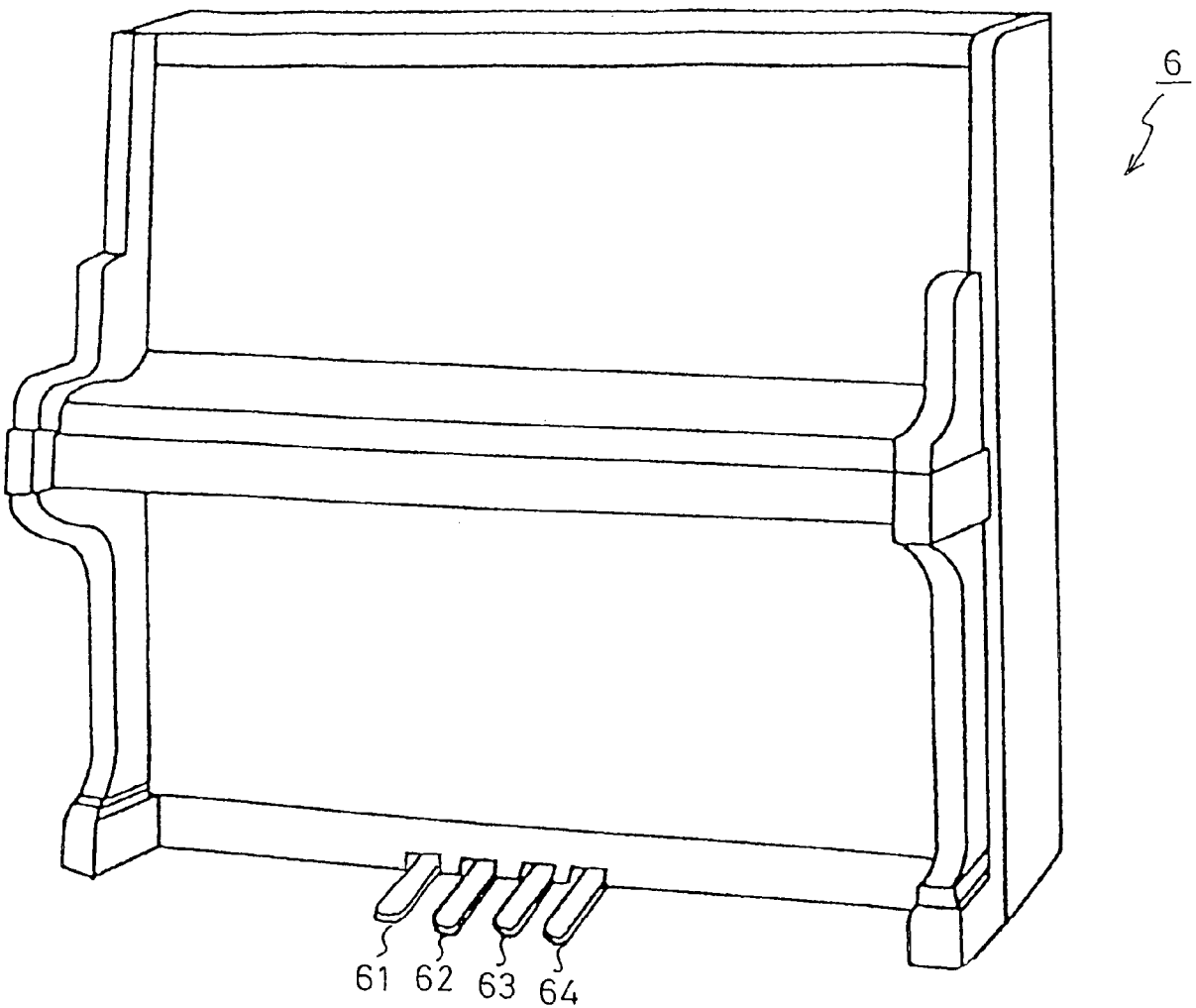
FIG. 9 is a front view of a grand piano according to a fifth embodiment.

FIG. 9 is a front view of an upright piano.

The upright piano 6 is provided with, from the left in FIG. 9, a weight pedal 61, a soft pedal 62, a sostenute pedal 63, and a damper pedal 64, in the middle of the lowest part of the main body.

One end of the weight pedal 61 is rotatably supported to the main body and the other free end is biased upward and fixed at a predetermined playing position where it is easy for the player to step on the free end for operation.

The weight pedal 61 is connected to an arm 81 (see FIG. 4) via a connecting member which transmits the motion of the weight pedal 61. When the weight pedal 61 is operated, the arm 81 is rotated about a shaft 87 (see FIG. 4).

Accordingly, in the upright piano 6 of the present embodiment, operation of the weight pedal 61 can change the position of the weight lever 21 (see FIG. 4). Along with the change, the operating point of the weight lever 21 is moved. As a result, the static loading applied to the key 3 can be adjusted consecutively by operating the weight pedal 61 during the play. Thus, the upright piano 6 of the present embodiment can generate sound having strength and softness which could have never been produced by a conventional piano.

The present embodiment is explained using an upright piano. However, a grand piano may include the weight pedal 61 as well. It is also possible to connect the L-shaped fitting 41 and the weight pedal 61 via a connecting member so that the static loading of the key 3 can be adjusted.

In the above description, embodiments of the present invention were described. However, the present invention is not limited to the above embodiments, and other modifications and variations may be possible.

For example, a groove may be created on the undersurface of the weight lever 21 of the first embodiment. The contacting part 25 may be designed to move in the front-side and rear-side directions with respect to the groove. In this manner as well, the operating point of the swing of the weight lever 21 can be adjusted, thus making possible the adjustment of the static loading of the key 3.

Figure 10:
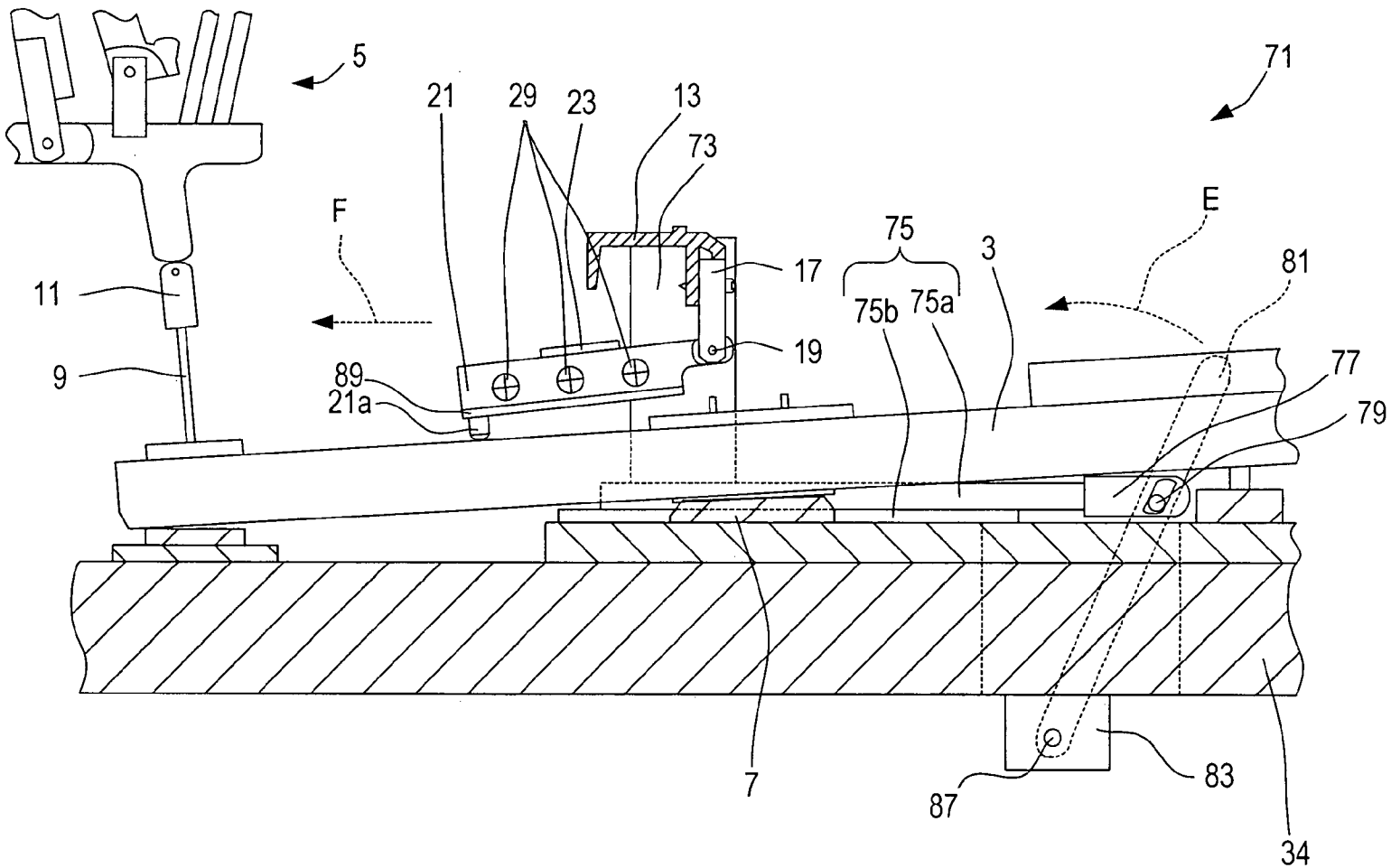
FIG. 10 is a side view showing a string-striking device for an upright piano.
Figure 11:
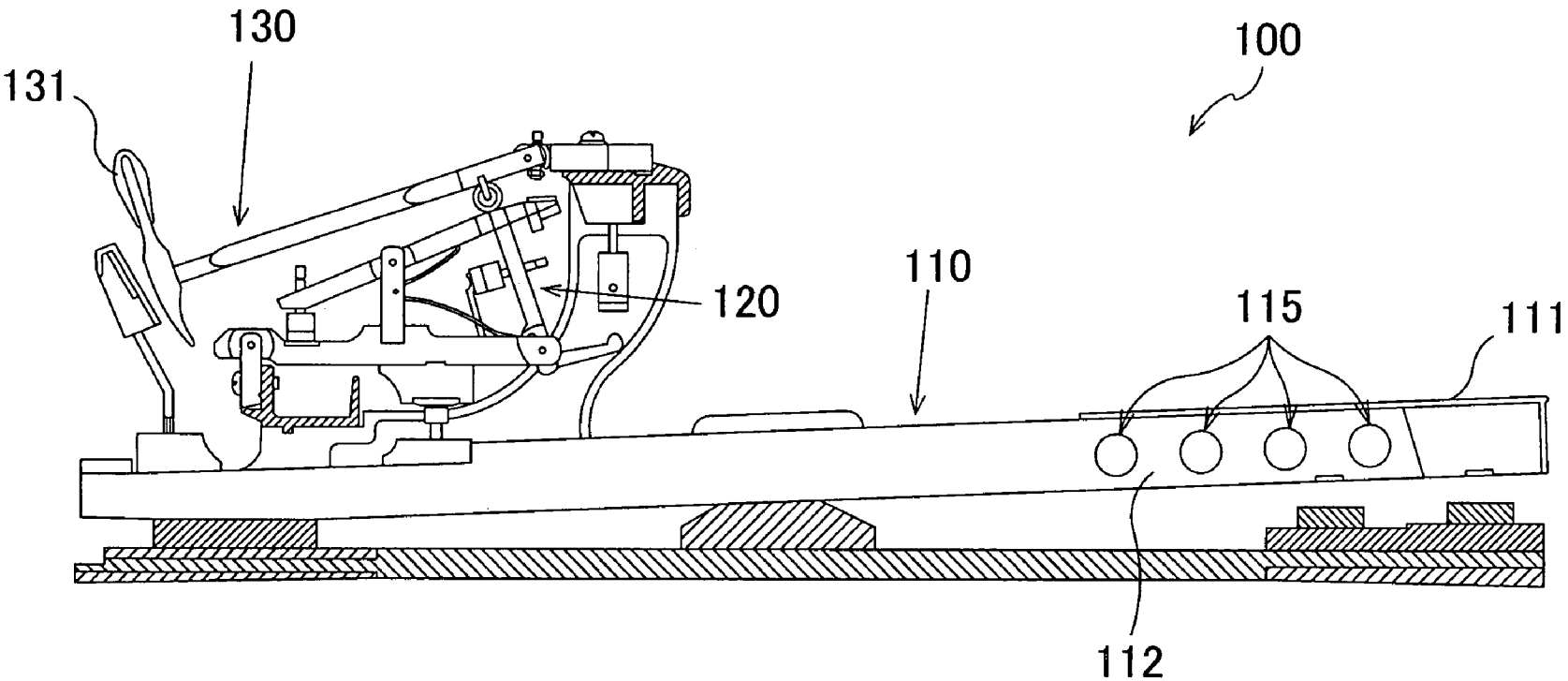
FIG. 11 is a side view showing a conventional string-striking device for a grand piano.

The third to fifth embodiments describe the lever receiving screw 85 provided on the side of the key 3, as an example. However, as shown in FIG. 10, a screw 21*a* may be provided on the side of the lever 21. If the screw 21*a* is provided on the side of the lever 21 as such, the sharp increase of the static loading with respect to the moving distance, which was explained in the forth embodiment, does not happen. Moreover, the moving distance is almost proportional to the static loading. Thus, more sensitive control of the static loading of the key 3 is possible. Furthermore, if the screw 21*a* is provided on the side of the lever 21 and the lever 21 is operated by the weight pedal 61 of the fifth embodiment, the static loading of the key 3 can be sensitively controlled by the weight pedal 21, thereby allowing a broader range of play.

INDUSTRIAL AVAILABILITY

The present invention can provide a string-striking device for a piano which permits easy adjustment of static loading applied to a fore-end on the playing side of a key.

The invention claimed is:

1. A string-striking device for a piano comprising:

a long weight lever, one for every key, which is disposed along a length direction of the key at an upper part on a side opposite to a playing side of the key and which is arranged such that one end of the weight lever is fixed to a piano body so as to allow the weight lever to freely swing up and down, and the other open end, which can be vertically displaced, is brought into contact with an upper surface of the key and applies its own weight on the key;

a long lifting rail disposed between the weight lever and the key so that the lifting rail extends over a plurality of keys and is fixed to the piano body in such a manner that, by lifting the weight levers, the lifting rail can displace the weight levers from a normal position, where the levers can touch the keys, to a holding position, where the levers are separated from the keys;

a first end of a connecting member connected to the lifting rail and an other end extending outside the piano, the lifting rail being displaceable by operating the other end of the connecting member outside the piano; and the other end of the connecting member being a playing pedal.

2. The string-striking device for a piano according to claim 1, further comprising a long stopper rail that is secured to the piano body above the weight lever so that the stop rail extends over a plurality of weight levers and restricts upward swing of the plurality of weight levers.

3. The string-striking device for a piano according to claim 1, further comprising a moving mechanism that moves the weight lever along the length direction of the key.

4. The string-striking device for a piano according to claim 1, wherein a part at which the weight lever touches the key comprises a roller that can roll along the upper surface of the key.

5. The string-striking device for a piano according to claim 1, wherein a lever receiving screw is provided on a surface of the key facing the weight lever while a frictional reducing layer is provided on an undersurface of the weight lever facing the lever receiving screw, the friction reducing layer being made from a material that allows a frictional force between the lever receiving screw and the weight lever to be smaller than the frictional force produced by direct contact there between, and the friction reducing layer is made from a material that allows the frictional force to be smaller as the friction reducing layer is provided closer to a rotation shaft which is a center of swing of the weight lever.

* * * * *